United States Patent [19]

Bantner

[11] 4,168,025

[45] Sep. 18, 1979

[54] DUAL TANK CARRIER

[76] Inventor: Maurice E. Bantner, 15573 Shirley Cir., Omaha, Nebr. 68144

[21] Appl. No.: 918,144

[22] Filed: Jun. 22, 1978

[51] Int. Cl.[2] ..... B65D 71/00

[52] U.S. Cl. ..... 224/45 P; 294/27 H; 16/114 R

[58] Field of Search ..... 224/45 P, 45 A, 45 AA, 224/45 T; 215/100 A, 100 R; 294/27 H, 26, 87 R; 16/110.5, 114 R, 124

[56] References Cited

U.S. PATENT DOCUMENTS

| | | | |
|---|---|---|---|
| 1,005,235 | 10/1911 | Langguth | 224/45 AA |
| 1,349,457 | 8/1920 | Hurd | 224/45 P |
| 1,645,839 | 10/1927 | Westerfield | 224/45 P |
| 2,234,458 | 3/1941 | Underhill | 224/45 AA |

*Primary Examiner*—Robert J. Spar
*Assistant Examiner*—Kenneth Noland
*Attorney, Agent, or Firm*—Hiram A. Sturges

[57] ABSTRACT

A tank carrier having a horizontally extending handle, a pair of hooks below the handle and facing in opposite directions and opening upwardly, the hooks being receivable in slots of connectors attached to the tops of compressed air tanks and beneath the valves thereof so that two tanks can be carried in vertical suspension from the hooks.

1 Claim, 4 Drawing Figures

DUAL TANK CARRIER

BACKGROUND OF THE INVENTION

This invention is in the field of compressed air tanks used primarily for fire-fighting and needed for rapid replacement of exhausted compressed air tanks carried on the backs of firemen as they go into a fire with masks on supplied with air from the tanks on the firemen's backs.

The air in such a tank is quickly exhausted, and there is great danger involved. When a tank is exhausted and there is no other tank to replace it, then a fireman can no longer work with the safety of a gas mask. Rescue work or fire-fighting by that fireman must then stop until he can make his way down and out of a building to get a replacement tank.

When a building has multiple stories, the time required to go back outside to get another tank is so critical that sometimes even the fireman dies from lack of oxygen on his way back out of the building.

When a fireman is rapidly entering a building, he needs to be able to carry a pack full of equipment in one hand, and in the prior art, this leaves only the possibility of carrying one replacement tank in his other hand.

Since tanks are so quickly exhausted, it is important to be able to have more tanks available than just one replacement tank. It is my concept that a dual tank carrier would enable a fireman to carry two tanks with the same hand, thereby doubling the amount of available compressed air being moved into the emergency area.

Another objective of this invention is to provide for the possibility of a fireman, who is not otherwise burdended, to be able to carry four tanks, two tanks in each hand by the use of two carriers of this invention.

I have found that when tanks are carried in this way, it is important that they remain parallel and not twist out of place with respect to each other, that they stay vertical during rapid movement of the fireman, whereby they are easier to carry, interfere less with the leg movements of the firemen, and remain vertical and parallel so that they are adapted to be easily and quickly placed on a horizontal floor surface in standing up position without falling over from the angles with respect to the vertical that they might shift into.

An object of this invention is to provide the concept of so making a dual tank carrier that the tanks of a pair being carried are disposed in engagement with each other, whereby the frictional contact of one tank with the other will tend to prevent them from twisting with respect to the vertical so that it is easier for the fireman to walk and easier for the fireman to set the tanks up in vertical position ready for emergency use in the split seconds of time between life and death at fires.

Another object is to provide a dual tank carrier which has additional uses as a wrench for disconnecting hose fittings and operating valves of various kinds.

SUMMARY OF THE INVENTION

A major object of this invention is to provide a tank carrying assembly having a substantially horizontally extending handle, a pair of hooks disposed below the handle, each of the hooks facing in an opposite direction and each hook opening upwardly, handle support sections connecting the hooks to the handle, the handle being of sufficient horizontal dimension so the plurality of the fingers of an adult man's hand can be received against the underside of the handle, a pair of connectors having elongated hook-receiving openings extending vertically therethrough, each connector having a tank attachment opening at its other end extending vertically therethrough for receiving a compressed air tank assembly portion therethrough.

DESCRIPTION OF THE PREFERRED EMBODIMENT

Figure 1:
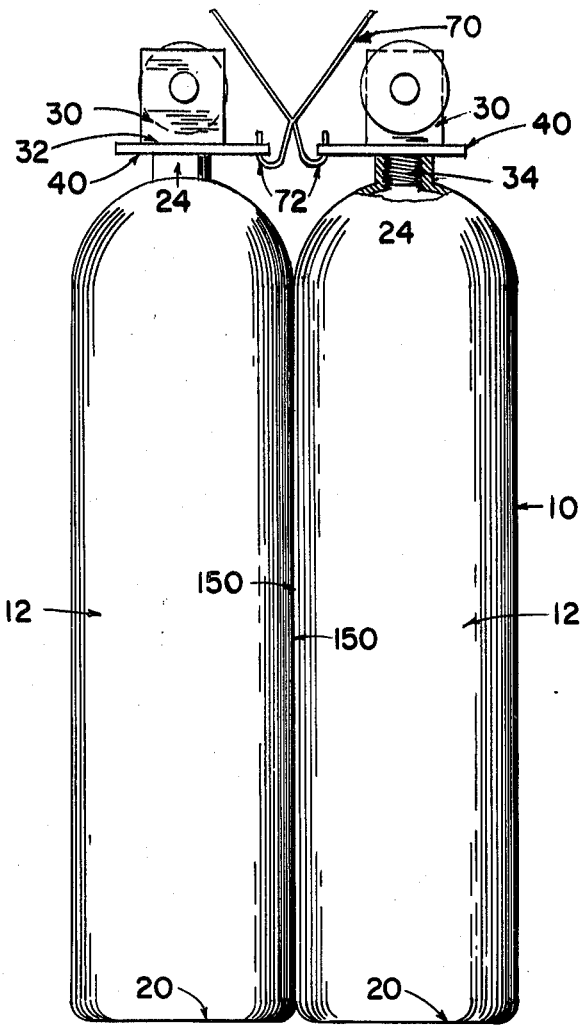
FIG. 1 is a frontal elevation of a pair of compressed air tanks shown with the dual tank carrier of this invention attached thereto in carrying position, a portion of one of the tanks being broken away for showing the interior.
Figure 2:
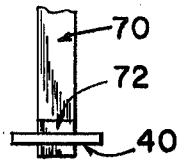
FIG. 2 is a side elevation of the tank carrying assembly of FIG. 1 as it would be seen from the right hand side in FIG. 1 with the tanks removed.

A dual tank carrier assembly of this invention is generally indicated in FIG. 1 at 10 and comprises a pair of tanks 12 containing compressed air for use with oxygen mask assemblies by firemen.

The tanks 12 are identical and vertically elongated. Sometimes they are flat on their bottom sides, as shown at 20, but the important thing is that they contain compressed air and are heavy.

At the top of a tank 12 is a neck 24 which has an internally threaded opening at its upper side, not shown, into which a valve block 38 is threaded, such valve blocks having shoulders 32 on their undersides extending horizontally outward from a downwardly extending threaded protrusion 34, which latter is received threadedly in the neck 24 of a tank 12.

Figure 4:
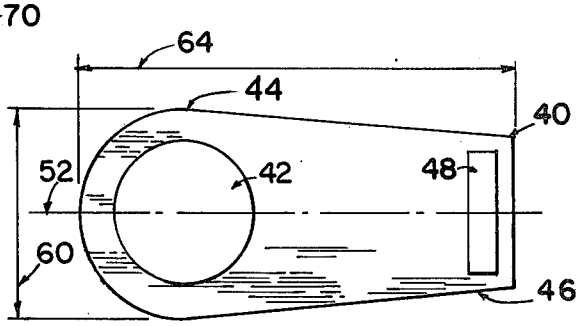
FIG. 4 is a top plan view of a tank connector which is connected to the tank for carrying the tank for carrying the tank by the handle.

In the prior art a connector somewhat of the type of the connectors 40 of FIGS. 1 and 4 have been firmly attached to the tank 12 by placing a circular opening 42 of a connector around the protrusion 34 so that the connector 40 is pressed between a valve block 38 and the top of a neck 24.

In this way, a connector 40 is firmly held in place on a tank as is customary in the prior art.

The connector 40 shown in FIG. 4 can be seen to have in top plan view an end 44 of larger width in which the hole 42 is disposed and a narrower end 46 in which is disposed an elongated narrow opening 48, which latter is elongated at 90 degrees with respect to an axis 52 extending through a center of the circular opening 42 and through a center of the length of the elongated opening 48.

The connector 40 is relatively thin vertically and can be of one-sixteenth of an inch thickness, for example, with a maximum width 60 at the hole 42 of two inches, for example, and a length 64 which can be four and one-fourth inches, the hole 42 having a diameter of one and three-eights inches.

It is to be understood, however, that when tank dimensions vary, then the connectors 40 will vary in length, size of hole 42, and also in width.

Figure 3:
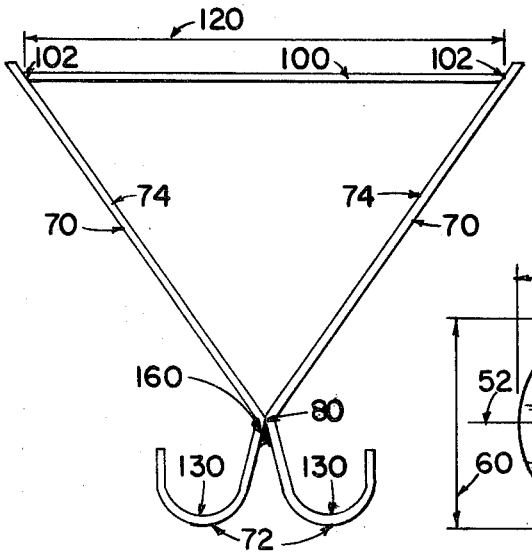
FIG. 3 is a frontal elevation of a tank carrier of this invention, as seen in detail in Frontal elevation.

I have found that a width for the narrow opening 48 of one-fourth of an inch is satisfactory for use with a dual tank carrier generally indicated at 70 of this invention seen in FIGS. 1 and 3.

The carrier 70 has a pair of hooks 72 which face in opposite directions from each other and each hook is formed integrally of one piece with a handle support section 74 of which there are two.

The handle support sections 74 diverge outwardly to the right and left from a point 80 which is approximately one and three-fourths inches above the bottom of the hooks 72.

The handle support sections 74 and hooks 72 are formed of steel bar stock of a thickness for conveniently allowing the hooks 72 to fit in the openings 48 of the connectors 40.

I found that a thickness for the hooks and for the handle support sections 74 of one-eighth of an inch is effective.

The height of the upper ends of the handle support sections 74 from the bottoms of the hooks 72 I have found effective at five and one-fourth inches with a handle 100 extending between and attached to the upper ends of the inner sides of the handle support sections 74 a short distance downwardly from the tops thereof, such as an eighth of an inch from the top thereof.

The handle 70 has been found to be effective when steel stock of one-fourth inch diameter is used, since firemen are usually wearing gloves. The ends of the handle 100 are welded at 102 to the inner sides of the handle supports 74 respectively so that the handle 100 extends straight and horizontal.

The distance 120 from one end of the handle 100 to the other is effective at four and five-sixteenths inches.

It is important that the lowermost point 130 in the upper sides of each of the hooks 72 be so positioned when the carrier 70 is hooked between two connectors 40, as shown in FIG. 1, that the particular tanks 12 which are being carried have their adjacent sides 150 against each other so that the frictional engagement of the tanks against each other will tend to prevent them from shifting with respect to each other and becoming awkwardly out of place at their lower ends, as can make them harder to carry and also not easy to set down quickly with their flat lower ends 20 on a floor because of their not hanging straight in the quick walking of the fireman in emergency.

It is to be understood that it is important that the tanks be easy to handle and that they hang straight down without any other connection than that accomplished by the carrier 70 and the connectors 40, even though the firemen be moving fast in an emergency, so that it is easy for the fireman to quickly store the tanks in an upright position on a floor, disconnect the hooks 72 and work on the fire with the tanks standing ready, disconnected from each other and ready for being grabbed quickly as needed in a fire emergency.

I claim:

1. A dual tank carrier assembly and tank assembly combination, said dual tank carrier assembly comprising a dual tank comprising: a substantially horizontally extending handle, a pair of hooks disposed below said handle, each of said hooks facing in an opposite direction and each hook opening upwardly, means rigidly connecting said hooks to said handle, said handle being of sufficient horizontal dimension that a plurality of the fingers of an adult man's hand can be received against the underside of said handle, connector means having an opening in one end extending vertically therethrough and receiving one of said hooks upwardly extending through said opening, means at the other end of said connector means for facilitating the attachment of said connector means to said tank assembly, said tank assembly comprising a pair of compressed air tanks having valves attached to the tops thereof, said connector means comprising a first connector and being connected at its other end to one of said tanks, a second connector connected at its respective other end to the other of said tanks, the hook receiving openings of each of said connectors being adjacent each other when the tank assembly is to be carried, and the hooks of the dual tank carrier assembly extending upwardly through respective ones of said hook-receiving openings of respective connectors.

* * * * *